US008807941B2

(12) United States Patent
Ferslew et al.

(10) Patent No.: US 8,807,941 B2
(45) Date of Patent: Aug. 19, 2014

(54) CROSS-OVER PURGE FLOW SYSTEM FOR A TURBOMACHINE WHEEL MEMBER

(75) Inventors: Matthew Ryan Ferslew, Johnson City, TN (US); Narendra Are, Greenville, SC (US); Matthew Paul Forcier, Manchester, CT (US)

(73) Assignee: General Electric Company, Schenectady, NY (US)

( * ) Notice: Subject to any disclaimer, the term of this patent is extended or adjusted under 35 U.S.C. 154(b) by 823 days.

(21) Appl. No.: 13/020,499

(22) Filed: Feb. 3, 2011

(65) Prior Publication Data

US 2012/0201652 A1 Aug. 9, 2012

(51) Int. Cl.

| | |
|---|---|
| ***F01D 5/08*** | (2006.01) |
| ***F01D 25/12*** | (2006.01) |
| ***F01D 25/08*** | (2006.01) |
| ***F01D 5/02*** | (2006.01) |
| ***F01D 5/06*** | (2006.01) |

(52) U.S. Cl.

CPC *F01D 5/08* (2013.01); *F01D 5/082* (2013.01); *F01D 25/12* (2013.01); *F01D 25/08* (2013.01); *F01D 5/087* (2013.01); *F01D 5/022* (2013.01); *F01D 5/06* (2013.01)

USPC ..... 416/90 R; 416/93 R; 415/115

(58) Field of Classification Search

USPC ..... 415/1, 115, 116, 177, 144; 416/93 R, 416/91, 90 R, 179, 244 A

See application file for complete search history.

(56) References Cited

U.S. PATENT DOCUMENTS

| | | | | |
|---|---|---|---|---|
| 6,382,903 | B1 * | 5/2002 | Caruso et al. | 415/1 |
| 6,438,837 | B1 | 8/2002 | Berry et al. | |
| 6,450,768 | B2 | 9/2002 | Mashey | |
| 6,464,461 | B2 | 10/2002 | Wilson et al. | |
| 2010/0178168 | A1 * | 7/2010 | Desai et al. | 416/95 |

* cited by examiner

*Primary Examiner* — Edward Look
*Assistant Examiner* — Maxime Adjagbe
(74) *Attorney, Agent, or Firm* — Cantor Colburn LLP

(57) ABSTRACT

A wheel member includes a body having a first surface that extends to a second surface through an intermediate portion. The body includes an outer diametric surface and a central bore. A first plurality of purge circuits are formed in the body. The first plurality of purge circuits extend from a first end to a second end through the body. The first plurality of purge circuits are arranged to direct a first purge flow in a first direction. A second plurality of purge circuits are formed in the body and fluidly isolated from the first plurality of purge circuits. The second plurality of purge circuits extend from a first end portion to a second end portion through the body and are arranged to direct a second purge flow in a second direction, that is distinct from the first direction, to establish a cross-over purge flow system.

17 Claims, 5 Drawing Sheets

CROSS-OVER PURGE FLOW SYSTEM FOR A TURBOMACHINE WHEEL MEMBER

BACKGROUND OF THE INVENTION

The subject matter disclosed herein relates to the art of turbomachines and, more particularly, to a cross-over purge flow system for a turbomachine wheel member.

Gas turbomachines include internal and rotating, components that may be subjected to high temperatures. In a compressor, rotor components are subjected to high temperatures and temperature gradients that lead to low cycle fatigue, embrittlement, and creep, all of which have a detrimental effect on system performance and durability. In order to enhance system performance and extend component life, turbomachines include purge systems that direct cooling air flows onto various components. Existing purge systems rely on a single stage pressure drop to drive air flow around wheel surfaces. A purge air flow starts at a region of higher pressure in the flowpath, travels inward toward a wheel bore region, and back to a region of lower pressure in the flowpath. In this manner, the purge air flow reduces temperature gradients as well as lowers peak rotor wheel temperature to enhance component life and turbomachine operability.

BRIEF DESCRIPTION OF THE INVENTION

According to one aspect of the exemplary embodiment, a wheel member includes a body having a first surface that extends to a second surface through an intermediate portion. The body includes an outer diametric surface and a central bore. A first plurality of purge circuits are formed in the body. The first plurality of purge circuits extend from a first end to a second end through the body. The first plurality of purge circuits are arranged to direct a first purge flow in a first direction. A second plurality of purge circuits are also formed in the body and are fluidly isolated from the first plurality of purge circuits. The second plurality of purge circuits extend from a first end portion to a second end portion through the body and are arranged to direct a second purge flow in a second direction, that is distinct from the first direction, to establish a cross-over purge flow.

According to another aspect of the exemplary embodiment, a turbomachine includes a compressor portion, and a turbine portion operatively connected to the compressor portion. At least one of the compressor portion and turbine portion includes a wheel member that includes a body having a first surface that extends to a second surface through an intermediate portion. The body includes an outer diametric surface and a central bore. A first plurality of purge circuits are formed in the body. The first plurality of purge circuits extend from a first end to a second end through the body. The first plurality of purge circuits are arranged to direct a first purge flow in a first direction. A second plurality of purge circuits are also formed in the body and are fluidly isolated from the first plurality of purge circuits. The second plurality of purge circuits extend from a first end portion to a second end portion through the body and are arranged to direct a second purge flow in a second direction, that is distinct from the first direction, to establish a cross-over purge flow.

According to yet another aspect of the exemplary embodiment, a method of delivering a cross-over purge flow in a turbomachine includes passing a first purge flow from a flowpath of the turbomachine toward a wheel member, passing a second purge flow from a wheel space of the turbomachine along the wheel member, guiding the first purge flow through a first purge flow circuit formed in the wheel member, guiding the second purge flow through a second purge flow circuit, fluidly isolated from the first purge circuit, formed in the wheel member, discharging the first purge flow from the first purge flow circuit toward a central bore of the wheel member, and discharging the second purge flow from the second purge flow circuit toward the flowpath to establish a cross-over purge flow at the wheel member.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
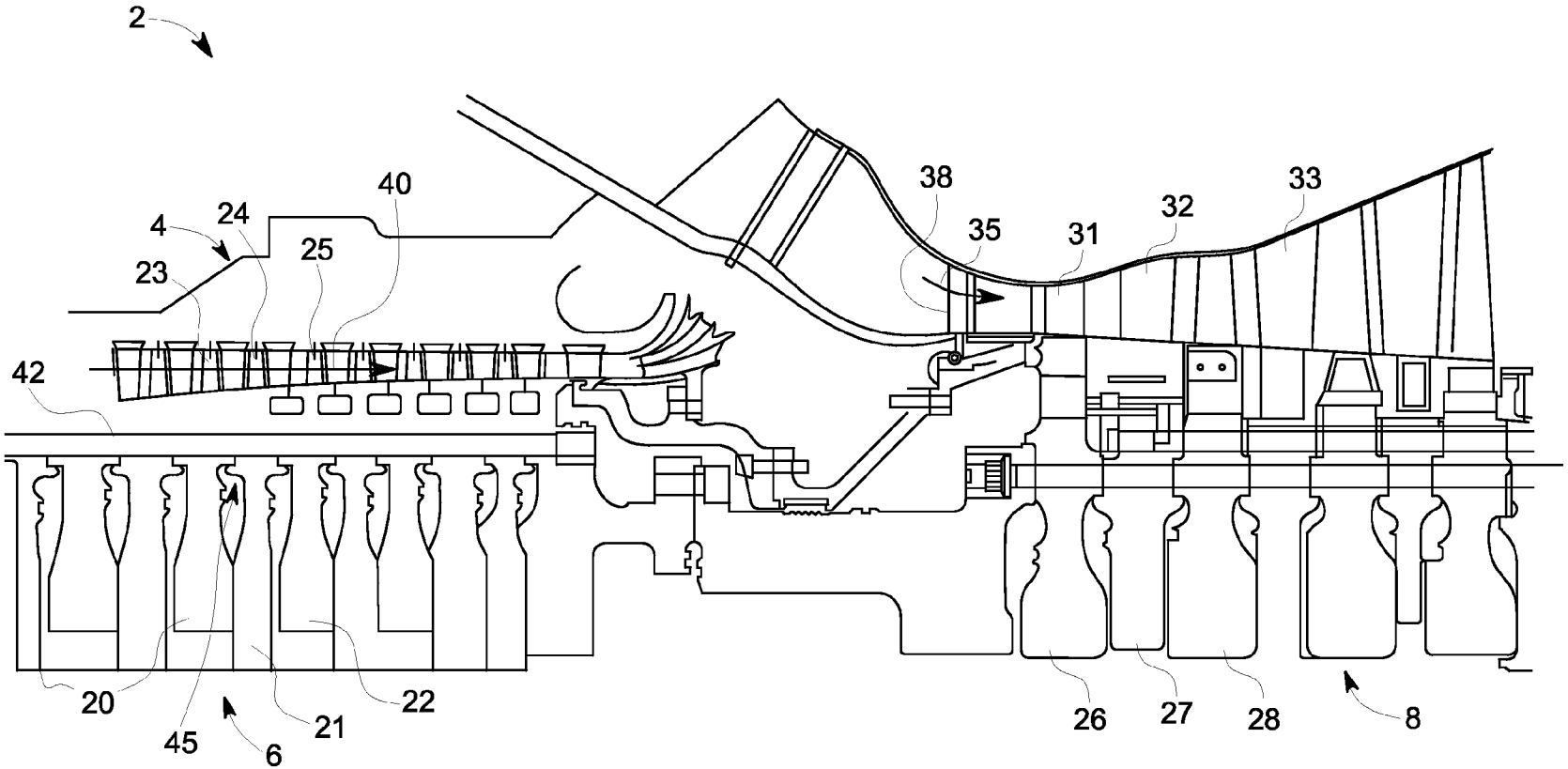
FIG. 1 is a cross-sectional schematic view of a turbomachine including a cross-over purge flow arrangement in accordance with an exemplary embodiment.
Figure 2:
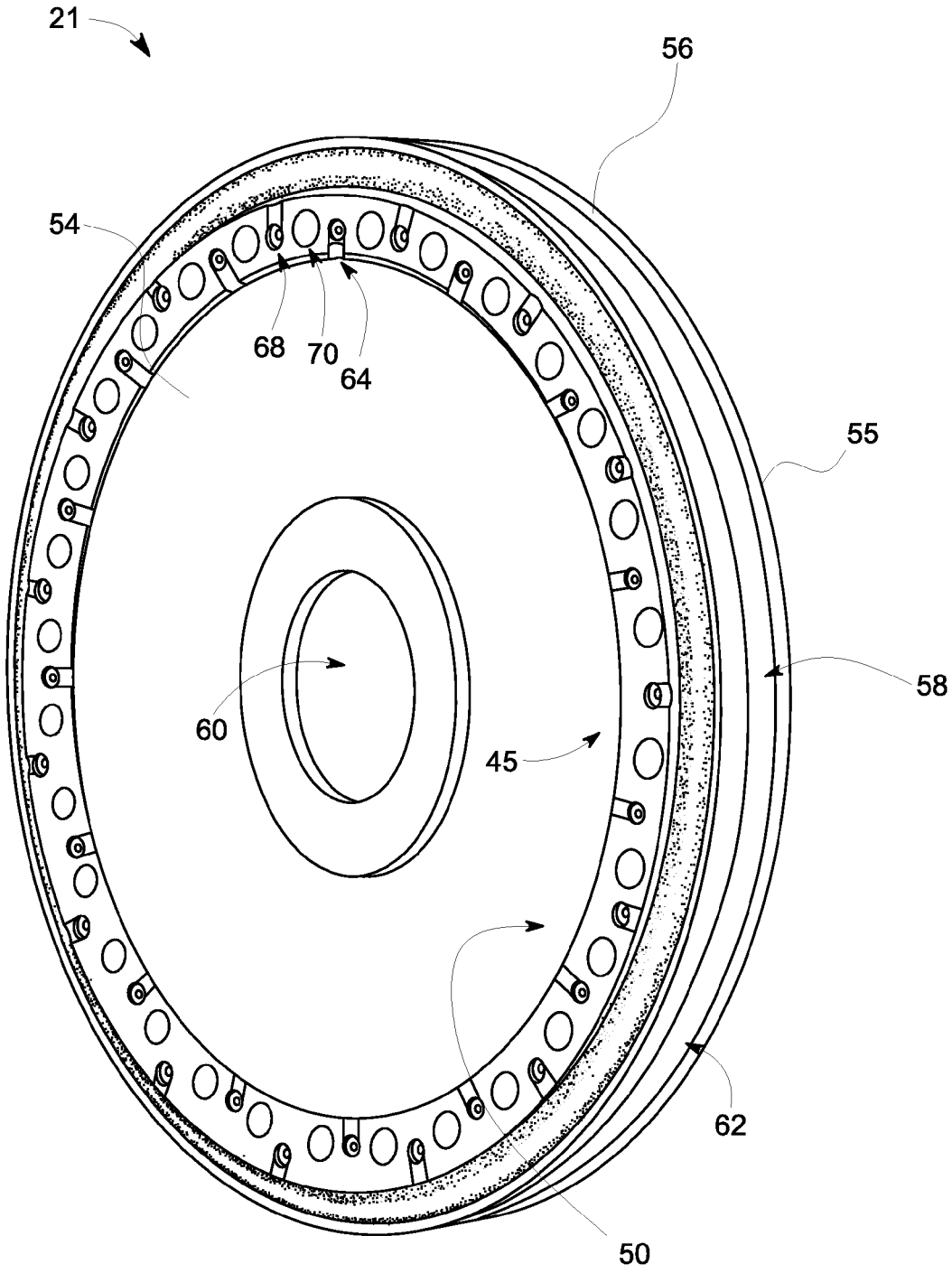
FIG. 2 is a perspective view of a wheel member including a cross-over purge flow arrangement in accordance with the exemplary embodiment.
Figure 3:
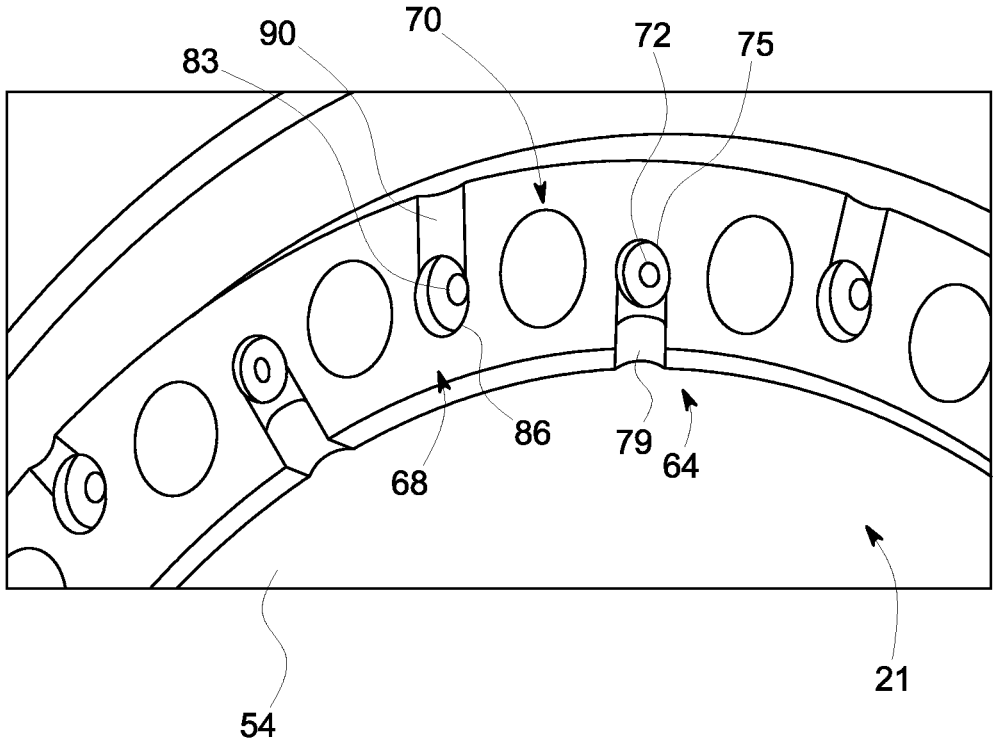
FIG. 3 is a partial perspective view of a first side of the wheel member of FIG. 2.
Figure 4:
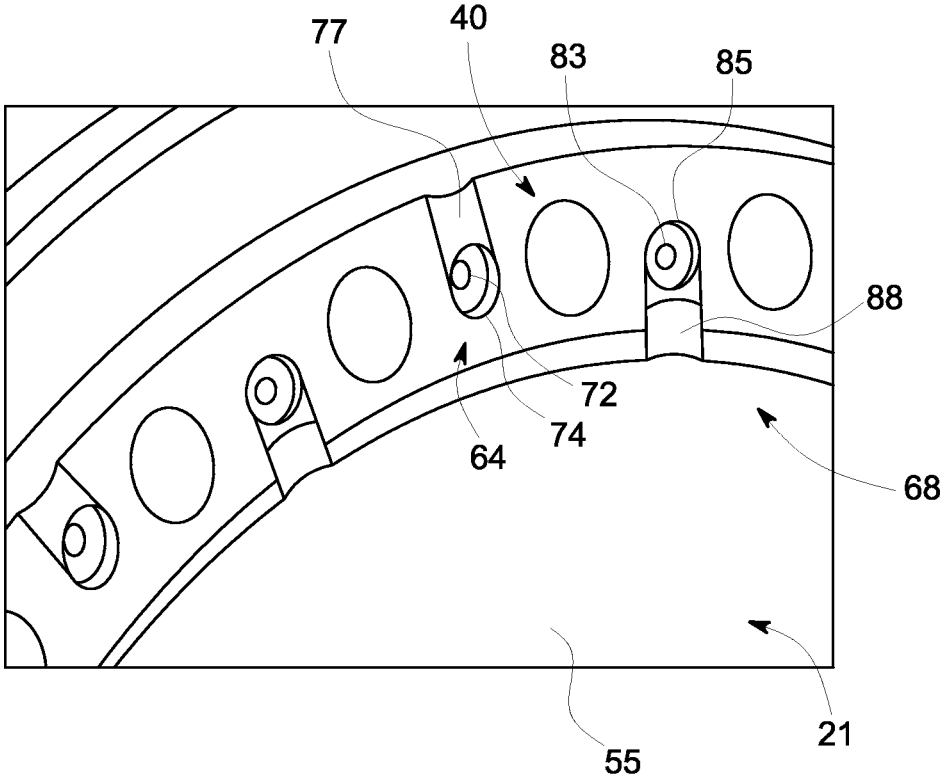
FIG. 4 is a partial perspective view of a second side of the wheel member of FIG. 2.
Figure 5:
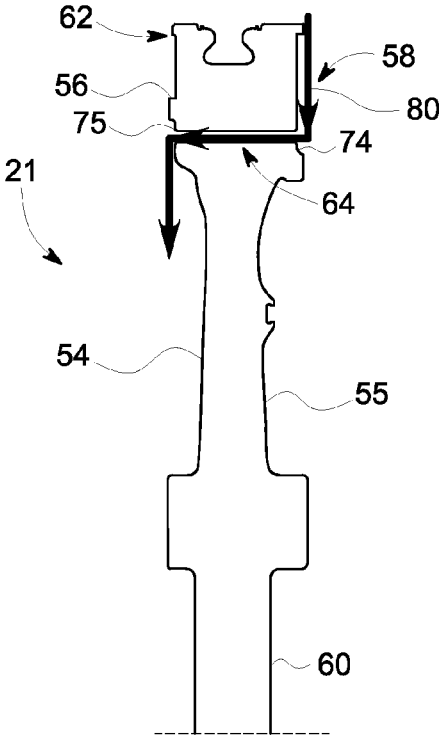
FIG. 5 is a schematic view of the wheel member of FIG. 2 illustrating a first cross-over flow circuit.
Figure 6:
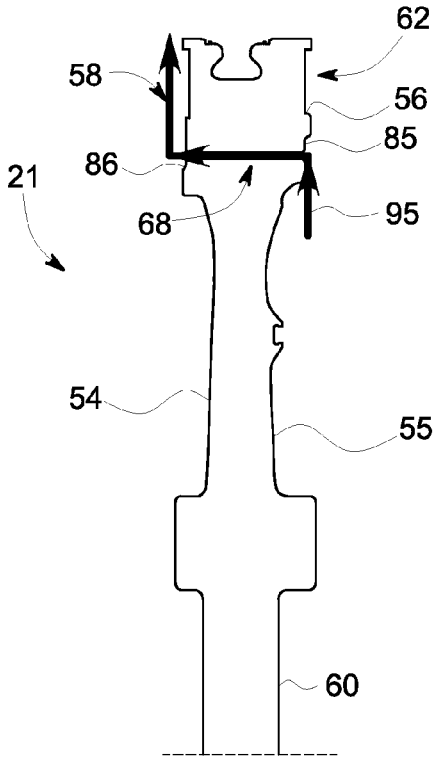
FIG. 6 is a schematic view of the wheel member of FIG. 2 illustrating a second cross-over flow circuit.

With reference to FIG. 1, a turbomachine in accordance with an exemplary embodiment is indicated generally at 2. Turbomachine 2 includes a housing 4 that surrounds a compressor portion 6 operatively connected to a turbine portion 8. Compressor portion 6 includes a plurality of rotor or wheel members, three of which are indicated at 20-22. Each wheel member 20-22 is operatively connected to corresponding pluralities of vanes or blades 23-25 that establish various stages of compressor portion 6. Similarly, turbine portion 8 includes a plurality of rotor or wheel members, three of which are indicated at 26-28. Each wheel member 26-28 is operatively connected to corresponding pluralities of vanes or blades 31-33 that establish various stages of turbine section 8.

With this arrangement, hot combustion gases 35 flowing from a combustor (not shown) enter a hot gas path 38 and flow into turbine portion 8. Hot combustion gases 35 flow across vanes 31-33 of turbine portion 8 developing mechanical energy. In addition, as will become more fully evident below, compressor flow 40 includes purge flows that are diverted into wheel members 20-22 to provide desired air flow. As will be discussed more fully below, wheel member 21 includes a cross-over purge flow arrangement 45.

As best shown in FIGS. 2-6, wheel member 21 includes a body 50 having a first surface 54 that extends to an opposing second surface 55 through an intermediate portion 56. Wheel member 21 includes an outer diametric surface 58 and a central bore 60. A blade mounting member 62 is provided on outer diametric surface 58. Blade mounting member 62 provides an interface between the plurality of blades 24 and wheel member 21. In accordance with the exemplary embodiment, wheel member 21 includes a first plurality of purge circuits 64 and a second plurality of purge circuits 68 arranged in body 50 adjacent outer diametric surface 58. First and second plurality of purge circuits 64 and 68 alternate around a circumference of body 50 and are separated by a plurality of bolt passages 70.

In accordance with an exemplary embodiment, each of the first plurality of purge circuits 64 extend about a first circumference of wheel member 21 and include a conduit 72 having a first end 74, exposed at second surface 55, that extends through body 50 to a second end 75 that is exposed at first surface 54. First end 74 included an inlet channel 77 that extends from conduit 72 towards outer diametric surface 58. Second end 75 includes an outlet channel 79 that extends from conduit 72 towards central bore 60. With this arrangement, a first purge flow 80 of compressor flow 40 passes from extraction air passage 42 into inlet channel 77. First purge flow 80 of compressor flow 40 passes along conduit 72 toward second end 75 and exits through outlet channel 79 toward central bore 60.

Figure 7:
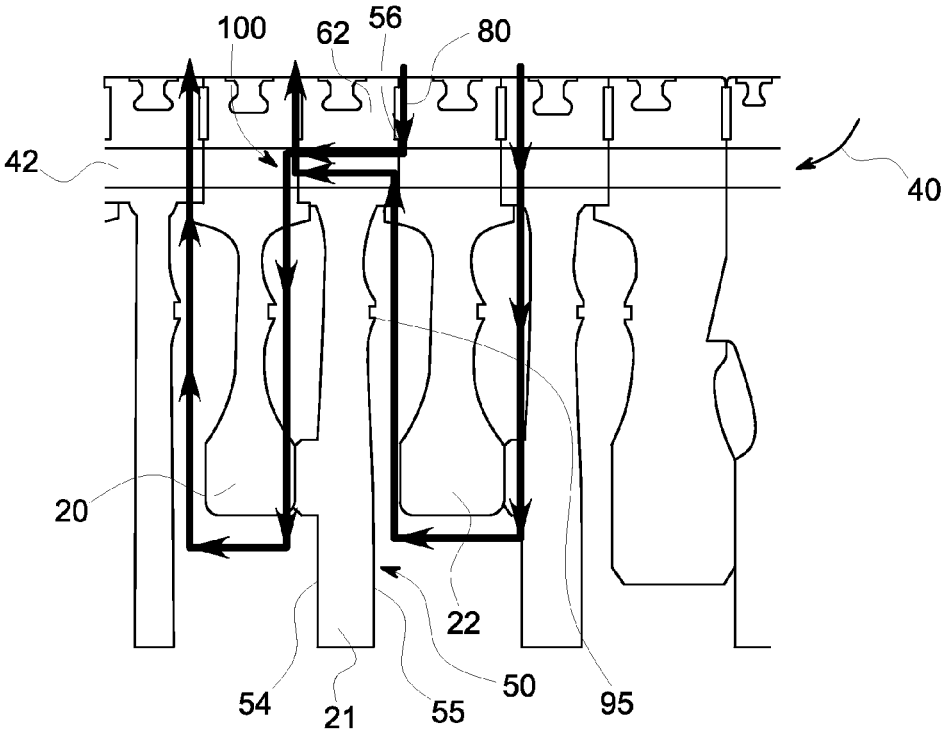
FIG. 7 is a schematic view of the rotor wheel of FIG. 2 illustrating a cross-over flow zone on the wheel member of FIG. 2.

In further accordance with the exemplary aspect, each of the second plurality of purge circuits 68 extend along a second circumference of wheel member 21 and include a conduit 83 having a first end portion 85, exposed at second surface 55, that extends through body 50 to a second end portion 86 exposed at first surface 54. In the exemplary embodiment shown, the first circumference is substantially similar to the second circumference. In addition, the first and second circumferences are arranged adjacent outer diametric surface 58. First end portion 85 includes an inlet passage 88 that extends from conduit 83 toward central bore 60. Second end portion 86 includes an outlet passage 90 that extends from conduit 83 toward outer diametric surface 58. With this arrangement, a second purge flow 95 of compressor flow 40 passes from a central bore (not separately labeled) of wheel member 22, along second surface 55 toward inlet passage 88. Second purge flow 95 of compressor flow 40 enters conduit 83, flows toward second end portion 86, and exits through outlet passage 90 toward outer diametric surface 58 forming a cross-over purge flow zone 100 such as shown in FIG. 7.

At this point it should be understood that the exemplary embodiments enable a single rotating component to carry two or more fully independent cooling circuits. Moreover, the particular arrangement allows for higher purge flows as a result of increased pressure drops of the purge flow passing through the wheel member. In addition, it should be understood that the placement of the purge passage in relation to the bolt passages creates a key feature that simplifies construction. That is, the purge passages are independent of an orientation and/or alignment of the bolt passages on adjacent wheels. Also, while shown extending about a single circumference of the wheel member, the first and second pluralities of purge circuits could be arranged at different radial distances from the central bore. Finally, it should be understood that the first and second pluralities of purge circuits could be provided on other ones of the wheel members in the compressor portion, or on wheel members in the turbine portion.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A wheel member comprising:

a body including a first surface that extends to a second surface through an intermediate portion, the body including an outer diametric surface and a central bore;

a first plurality of purge circuits formed in the body, the first plurality of purge circuits extending from a first end to a second end through the body, the first plurality of purge circuits including an inlet channel extending from the first end toward the outer diametric surface, the first plurality of purge circuits being arranged to direct a first purge flow in a first direction radially inwardly along the body; and a second plurality of purge circuits formed in the body and fluidly isolated from the first plurality of purge circuits, the second plurality of purge circuits extending from a first end portion to a second end portion through the body and being arranged to direct a second purge flow in a second direction radially outwardly along the body, to establish a cross-over purge flow.

2. The wheel member according to claim 1, further comprising: an outlet channel extending from the second end of each of the first plurality of purge circuits toward the central bore.

3. The wheel member according to claim 1, further comprising: an inlet passage extending from the first end portion of each of the second plurality of purge circuits toward the central bore.

4. The wheel member according to claim 3, further comprising: an outlet passage extending from the second end portion of each of the second plurality of purge circuits toward the outer diametric surface.

5. The wheel member according to claim 1, further comprising: a plurality of bolt passages formed in the body between corresponding ones of the first plurality of purge circuits and the second plurality of purge circuits.

6. The wheel member according to claim 1, wherein the first plurality of purge circuits extend along a first circumference of the body and the second plurality of purge circuits extend along a second circumference of the body.

7. The wheel member according to claim 6, wherein the first circumference is substantially similar to the second circumference.

8. The wheel member according to claim 6, wherein each of the first and second circumferences are adjacent the outer diametric surface.

9. The wheel member according to claim 1, further comprising: a blade mounting member arranged on the outer diametric surface.

10. A turbomachine comprising:

a compressor portion;

a turbine portion operatively connected to the compressor portion; and wherein at least one of the compressor portion and turbine portion includes a wheel member comprising:

a body including a first surface that extends to a second surface through an intermediate portion, the body including an outer diametric surface and a central bore;

a first plurality of purge circuits formed in the body, the first plurality of purge circuits extending from a first end to a second end through the body, the first plurality of purge circuits including an inlet channel extending from the first end toward the outer diametric surface, the first plurality of purge circuits being arranged to direct a first purge flow in a first direction radially inwardly along the body; and a second plurality of purge circuits formed in the body and fluidly isolated from the first plurality of purge circuits, the second plurality of purge circuits extending from a first end portion to a second end portion through the body and being arranged to direct a second purge flow in a second direction, radially outwardly along the body, to establish a cross-over purge flow.

11. The turbomachine according to claim 10, further comprising: an outlet channel extending from the second end of each of the first plurality of purge circuits and toward the central bore.

12. The turbomachine according to claim 10, further comprising: an inlet passage extending from the first end portion of each of the second plurality of purge circuits and toward the central bore.

13. The turbomachine according to claim 12, further comprising: an outlet passage extending from the second end portion of each of the second plurality of purge circuits toward the outer diametric surface.

14. The turbomachine according to claim 10, further comprising: a plurality of bolt passages formed in the body between corresponding ones of the first plurality of purge circuits and the second plurality of purge circuits.

15. The turbomachine according to claim 10, wherein the first plurality of purge circuits extend along a first circumference of the body and the second plurality of purge circuits extend along a second circumference of the body.

16. A method of delivering a cross-over purge flow in a turbomachine, the method comprising:

passing a first purge flow from a flowpath of the turbomachine toward a wheel member;

passing a second purge flow from a wheel space of the turbomachine along the wheel member;

guiding the first purge flow through a first purge flow circuit formed in the wheel member;

guiding the second purge flow through a second purge flow circuit, fluidly isolated from the first purge circuit, formed in the wheel member, discharging the first purge flow from the first purge flow circuit toward a central bore of the wheel member;

discharging the second purge flow from the second purge flow circuit toward the flow path establishing a cross-over purge flow at the wheel member; and passing the first purge flow through a central bore of an adjacent wheel member.

17. The method of claim 16, further comprising: directing the second purge flow toward a plurality of blades arranged on an outer diametric surface of the wheel member.

* * * * *